US006791453B1

(12) United States Patent
Andres et al.

(10) Patent No.: US 6,791,453 B1
(45) Date of Patent: Sep. 14, 2004

(54) COMMUNICATION PROTOCOL FOR INTERCONNECTED HAZARDOUS CONDITION DETECTORS, AND SYSTEM EMPLOYING SAME

(75) Inventors: John J. Andres, Colorado Springs, CO (US); Michael W. Apperson, Chapel Hill, NC (US); Joseph G DeLuca, Colorado Springs, CO (US); Chris R. Gilbert, Colorado Springs, CO (US); Craig Kleinberg, Colorado Springs, CO (US); Larry Ratzlaff, Elgin, IL (US); Stephen M. Ernst, Colorado Springs, CO (US); John Wurtenberger, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 262 days.

(21) Appl. No.: 09/638,091

(22) Filed: Aug. 11, 2000

(51) Int. Cl.[7] ..... G08B 9/00

(52) U.S. Cl. ..... 340/286.01; 340/286.05; 340/291; 340/639; 340/506; 340/693.6

(58) Field of Search ..... 340/286.05, 286.01, 340/287, 289, 291, 293, 628, 632, 639, 577, 584, 693.6, 506, 539, 514, 516, 517, 523

(56) References Cited

U.S. PATENT DOCUMENTS

| | | | | | |
|---|---|---|---|---|---|
| 3,665,461 | A | * | 5/1972 | Gnagi et al. | 340/409 |
| 3,872,355 | A | * | 3/1975 | Klein et al. | 340/310.01 |
| 4,080,568 | A | * | 3/1978 | Funk | 324/142 |
| 4,114,089 | A | * | 9/1978 | Ahmed | 340/651 |
| 4,163,226 | A | * | 7/1979 | Ogawa | 340/629 |
| 4,180,803 | A | | 12/1979 | Wesemeyer et al. | |
| 4,247,848 | A | | 1/1981 | Kitta et al. | |
| 4,733,224 | A | * | 3/1988 | Kimura | 340/521 |
| 5,627,515 | A | * | 5/1997 | Anderson | 340/517 |
| 5,705,979 | A | * | 1/1998 | Fierro | 340/517 |
| 5,708,414 | A | * | 1/1998 | Peltier et al. | 340/506 |
| 5,898,369 | A | * | 4/1999 | Godwin | 340/539 |
| 6,150,922 | A | | 11/2000 | Ackland et al. | |
| 6,229,429 | B1 | | 5/2001 | Horon | |
| 6,384,723 | B1 | * | 5/2002 | Keeler et al. | 340/513 |

* cited by examiner

*Primary Examiner*—Jeffery Hofsass
*Assistant Examiner*—Daniel Previl
(74) *Attorney, Agent, or Firm*—Merchant & Gould, P.C.

(57) ABSTRACT

Presented is a communications protocol for use by interconnected hazardous condition detectors, such as smoke and carbon monoxide detectors for use in dwellings and other structures. This communications protocol provides conventional signaling to indicate the presence of a smoke condition necessitating the generation of a smoke temporal pattern by all interconnected detectors. The protocol further defines a signaling method by which conventional smoke detectors that are incapable of providing temporal patterns other than that required for a smoke alarm condition will not be sent into an alarm mode of operation upon receipt of a signal other than the conventional smoke alarm signal. This communications protocol defines a pulsed signal to indicate a non-smoke alarm condition that is of a duration that will not trigger the conventional smoke alarms. To allow for the transmission of multiple hazardous conditions alarm notifications, as well as the transmission of additional hazardous condition detector control signals, the communications protocol utilizes a multi-bit signal transmitted via the conventional single signal I/O wire of currently existing interconnect wiring. Through the use of an 8 bit alarm signal, multiple hazardous conditions may be signaled as well as operating modes such as test, hush, reset, low battery, etc. Also presented are smoke, carbon monoxide, and combination hazardous condition detectors that utilize the communications protocol presented herein.

1 Claim, 4 Drawing Sheets

COMMUNICATION PROTOCOL FOR INTERCONNECTED HAZARDOUS CONDITION DETECTORS, AND SYSTEM EMPLOYING SAME

FIELD OF THE INVENTION

This invention relates generally to interconnected hazardous condition detectors, and more particularly to a communications protocol used by interconnected hazardous condition detectors to allow for proper alarm sounding by all interconnected units once a single unit has detected a hazardous condition.

BACKGROUND OF THE INVENTION

In the past many individuals were overcome by smoke and toxic gases in their sleep as a result of household fires occurring during the night. Many other individuals lost their lives to structural fires because they did not receive warning of the fire until it had advanced to a stage from which they were unable to escape. Luckily, advances in smoke detection technology have allowed the development of reliable smoke detectors that can awaken occupants of a house, and alert occupants of a structure of the presence of a fire at a very early stage. Specifically, many modem smoke detectors provide an indication that a fire or hazardous condition may be present long before the amount of smoke could be detected by a person. The effectiveness of these devices is so great that they are now mandated in many states, and indeed in many countries, for installation in multiple-family dwellings, and even in single-family homes.

Recognizing that the early detection of a fire affords the occupants of a dwelling the best possible chance for survival, many manufacturers, and indeed many building codes, recommend the installation of multiple smoke detectors throughout a dwelling positioned in key locations. As a minimum, it is recommended that at least one smoke detector be included on each level of a multi-level dwelling, e.g., one located in the basement, one on the first floor, one on the second floor, and one in the attic. For multi-unit dwellings, it is recommended that at least one smoke detector be included in each dwelling unit, as well as one in each common area shared by the units, such as a hallway or fourier.

While the inclusion of multiple smoke detectors maximizes the opportunity for early detection of a fire regardless of its point of origin, occupants of a dwelling may not be able to hear the audible alarm from the smoke detector in a location remote from their position within the dwelling. For example, if a smoke detector in the basement of a dwelling were to detect the presence of smoke and were to sound its alarm, an occupant located in a second floor bedroom who is sound asleep with a radio playing may not be awakened until the condition has progressed to a point where one of the other smoke detectors begins to sense the smoke condition and sound its alarm. As a further example, occupants in one dwelling unit of a multi-family dwelling may be unaware that a smoke alarm in another remotely located dwelling unit has sensed the presence of a fire because of the amount of sound insulation between individual family dwelling units. In these situations, precious moments may be lost until the fire has progressed to a point that smoke detectors in proximity to the individuals have sensed the condition.

To overcome such a situation, many smoke detector manufacturers provide the capability for interconnecting the various smoke detectors located within a dwelling. In this way, once a single smoke detector has detected the presence of smoke anywhere within the dwelling, a signal is sent to all other smoke detectors so that they may sound their alarms as well. Utilizing such a system in the examples discussed above would result in all of the occupants being notified the moment that a single smoke detector began sounding its alarm. Through the interconnection of individual smoke detectors, the sleeping occupant on the second floor would be awakened by the smoke detector located on the second floor the moment that the smoke detector in the basement sensed the presence of smoke. Likewise, the occupants in a multi-family dwelling would be notified by the smoke detector in their particular dwelling once any smoke detector located throughout the multi-family dwelling sensed the presence of smoke. By constructing an interconnected multi-detector system, occupants are provided with their best chance for survival because they will be notified the moment that any detector distributed throughout their dwelling detects the presence of smoke.

To ensure that smoke detectors from multiple manufacturers can be utilized in such a distributed, interconnected smoke detector system, most detectors are compatible with a 3-wire interconnection. In this standard 3-wire interconnect, a first wire is utilized to supply voltage to the smoke detector, a second wire is used as the return, and a third wire provides the alarm signal indication to all of the smoke detectors. With this standard interconnect, any smoke detector that detects the presence of smoke generates an output voltage signal on the third wire of the interconnect to signal all other detectors to sound their smoke alarms. This alarm voltage is a DC level, which has been selected to be 12 volts DC. This DC level was chosen to ensure that noise induced on this signal wire would not inadvertently cause other smoke detectors coupled thereto to sound their smoke alarms. The number of smoke detectors that can be interconnected through such a system vary based on the design of the individual smoke detectors, and in particular based on the design of the driver circuit for this signal wire. These systems are so effective in increasing the amount of warning provided to occupants of dwellings that such an interconnection system is a standard feature of most new construction.

While smoke detectors have a long history of providing early warning to occupants of a dwelling of a hazardous condition, and have therefore been integrated within the building plan of new dwellings as evidenced by the interconnection systems available for these detectors, carbon monoxide detectors are a relatively new entrant into the personal hazardous condition market. However, with the advances in the detection of carbon monoxide, many people are recognizing the benefits that such detectors provide. This is especially true in northern climates where occupants rely on furnaces and fireplaces to heat their dwellings during the winter months. Indeed, since carbon monoxide is a clear, odorless gas, it is nearly impossible for a sleeping occupant to detect its presence within the dwelling without the use of a carbon monoxide detector.

As with the acceptance and incorporation of smoke detectors, it is now recommended that at least one carbon monoxide detector be included on each level of a multi-level dwelling, and in each living unit of a multi-family dwelling as well as in the common areas. Unfortunately, the same problems that plagued the distributed network of smoke detectors prior to the interconnection system described above also plagues the system of multiple distributed carbon monoxide detectors. That is, the sounding of a carbon monoxide alarm in a remote location within the dwelling may not be perceived by an occupant in another location within the dwelling. While a separate 3-wire interconnection system could be utilized specifically for the carbon monoxide detectors, such increases the amount of interconnection wiring required within a dwelling. This would significantly increase the cost of such a system, and therefore reduce its desirability. Additionally, many modern detectors are combination units providing both smoke and carbon monoxide detection and alarming capability. To increase the desirability of these combination detectors, they are being manufactured to be compatible with the current interconnection system in use for smoke detectors.

The Underwriters' Laboratory standard UL2034 requires that the carbon monoxide alarm's temporal pattern be four (4) short chirps followed by a 4.5 second pause before repeating the four (4) short chirps. The UL217 standard requires that the smoke alarm's temporal pattern be three (3) long beeps, followed by a 1.5 second pause, before repeating. Since these two distinct temporal patterns are to signify two completely separate hazardous conditions, the UL also requires that all units must sound the appropriate temporal pattern for the corresponding hazard that is detected. For example, if a smoke detector detects the presence of smoke and it is interconnected to a carbon monoxide alarm, the carbon monoxide alarm must either sound the smoke temporal pattern or alternatively remain silent. Conversely, if a carbon monoxide detector senses the presence of carbon monoxide and it is interconnected to a smoke alarm, the smoke alarm must sound the carbon monoxide alarm temporal pattern or alternatively remain silent.

Unfortunately, conventional smoke and carbon monoxide detectors, when interconnected via the standard 3-wire interconnect described above, respond to a single signal sent via the single I/O wire. If no hazard is detected, there is no signal present on this wire. When either hazard is present, be it smoke or carbon monoxide, the originating unit will send a voltage through the I/O wire. Sensing this signal, the interconnected units will then go into their individual alarm modes. Utilizing this standard DC voltage signaling protocol, conventional interconnected smoke and carbon monoxide detectors have no way of distinguishing whether the interconnected signal came from a smoke alarm or a carbon monoxide alarm. For example, if a smoke detector senses the presence of smoke, it sends out the interconnected signal to which all of the alarms connected thereto will respond, including the carbon monoxide detector, by sounding their corresponding alarm temporal pattern. This may result in a carbon monoxide alarm temporal pattern being sounded when the hazard is actually smoke, and vice versa. This is strictly prohibited by the UL.

There exists, therefore, a need in the art for an interconnection communication protocol which is capable of using the existing standard 3-wire interconnect for hazardous condition detectors, but which is able to discriminate between smoke and carbon monoxide hazardous conditions and which is compatible with existing detectors already deployed throughout the market.

SUMMARY OF THE INVENTION

In view of the above, it is therefore an object of the instant invention to provide a new and improved communication protocol for interconnected hazardous detectors. It is a further object to provide a new and improved communication protocol that is fully compatible with the above-described standard 3 wire interconnect systems currently employed. It is an additional object of the instant invention to provide this new and improved communication protocol such that it is compatible with existing smoke detectors currently in service, as well as with smoke detectors manufactured to comply with the standard 3 wire interconnect systems described above. It is a further additional object of the instant invention to provide a new and improved communications protocol that enables both smoke and carbon monoxide detectors, as individual units or combination units, to be coupled via the standard 3 wire interconnect to form a distributed hazardous condition detection system. Additionally, it is an object of the instant invention to provide this communication protocol in such a manner so as to meet the Underwriters' Laboratories standards for proper temporal pattern alarming during each of the detected hazardous conditions.

It is an additional object of the instant invention to provide a new and improved hazardous condition detector that employs a communications protocol capable of distinguishing between sensed smoke and carbon monoxide alarm conditions. It is a further object that this new hazardous condition detector be compatible with standard 3 wire interconnection systems. Additionally, it is an object of the instant invention that the new hazardous condition detector detect both the presence of smoke and carbon monoxide, and be capable of providing distinct indication of these two conditions via the single I/O wire of the 3 wire interconnect. It is an additional object of the instant invention to provide a carbon monoxide detector, which is capable of being interconnected with other hazardous condition detectors via a standard 3 wire interconnect, and which will provide a carbon monoxide alarm temporal pattern when an appropriate carbon monoxide alarm signal is present on the single I/O wire, and further which will not sound a carbon monoxide alarm temporal pattern when a smoke alarm signal is present on the single I/O wire of the interconnect. It is the further object of the instant invention to provide a carbon monoxide detector that is capable of sounding the appropriate alarm temporal pattern based upon the signal received on the single I/O wire of the 3 wire interconnect.

Additionally, it is the further object of the instant invention to provide a combination smoke and carbon monoxide detector capable of utilizing standard, 3 wire interconnect systems to form a portion of a distributed hazardous condition detection and alarm system. It is a further object of the instant invention that this combination smoke and carbon monoxide detector utilize a communications protocol which distinguishes alarm types between smoke and carbon monoxide using the single I/O wire of the 3 wire interconnect. It is a further object of the instant invention to provide a smoke detector that is capable of understanding a communications protocol signaling at least two different hazardous conditions via the single I/O wire of the 3 wire interconnect, and which is capable of providing an appropriate alarm temporal pattern based upon the signal received.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 1:
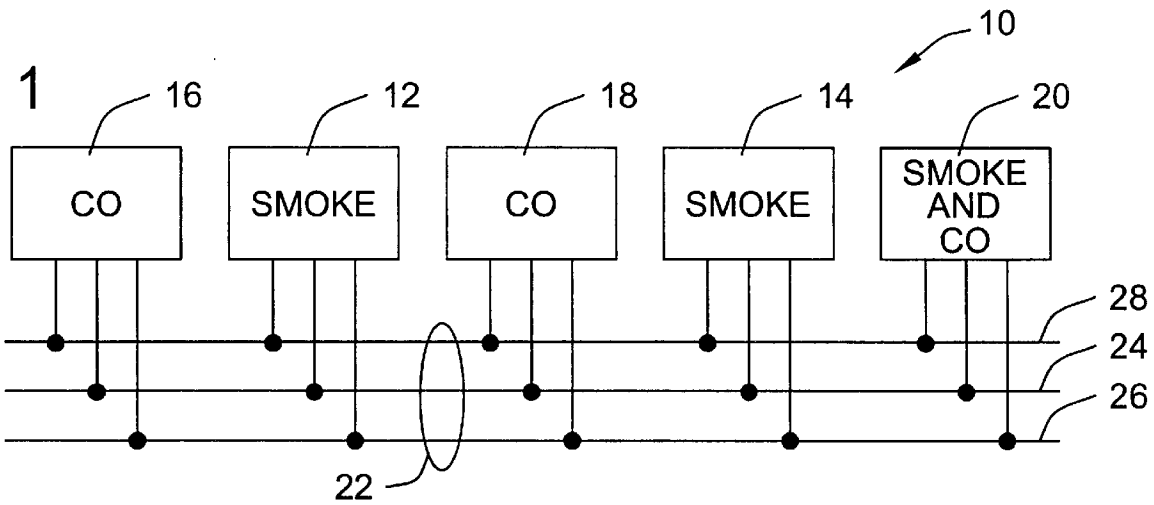
FIG. 1 is a system level block diagram illustrating a distributed, interconnected hazardous condition detection system constructed in accordance with the teachings of the instant invention.

Turning now to the drawings, and specifically to FIG. 1, there is illustrated an exemplary embodiment of a distributed hazardous condition detection system constructed in accordance with the teachings of the instant invention. Such a system 10 may include conventional smoke detectors 12 that do not understand the communications protocol of the instant invention, smoke detectors 14 that do understand the communications protocol of the instant invention, carbon monoxide detectors 16 that understand the communications protocol of the instant invention and are capable of sounding only a carbon monoxide alarm temporal pattern, carbon monoxide detectors 18 that understand the communications protocol of the instant invention and that are able to sound at least two different alarm temporal patterns based upon the hazardous condition detected by one of the units in the system 10, and multi-hazardous condition detectors 20 that understand the communications protocol of the instant invention and that are capable of sounding an appropriate alarm temporal pattern based upon the particular hazardous condition detected or communicated thereto. This interconnected system 10 utilizes a standard 3 wire interconnect 22. As indicated briefly above, this 3 wire interconnect 22 provides main AC power via line 24, a neutral wire 26, and a single signal wire 28 that is used to communicate an alarm condition to all units interconnected in the system 10. While system 10 is illustrated as having a particular configuration of distributed detectors 12–20, one skilled in the art will recognize that such a system 10 may include more or fewer detectors of different types. Indeed, one skilled in the art will recognize that the system 10 illustrated in FIG. 1 has been constructed to illustrate various aspects of the instant invention, and therefore is presented by way of illustration and not by way of limitation.

Recognizing that many different types and configurations of distributed detector systems exist using the standard 3 wire interconnect 22, it is important that the protocol of the instant invention be backward compatible with these prior interconnected systems. Specifically, the protocol of the instant invention must be capable of providing an indication to existing smoke detectors that they will recognize and that will cause them to enter their alarm mode of operation when a smoke condition has been sensed. Likewise, the protocol of the instant invention must be capable of providing an indication that a carbon monoxide or other hazardous condition has been sensed in such a manner that the conventional smoke detectors will not inadvertently enter their alarm condition and sound the smoke temporal pattern. As described above, the sounding of an alarm temporal pattern that is inappropriate for the actual sensed hazardous condition is specifically precluded by the Underwriters' Laboratory.

Figure 2:
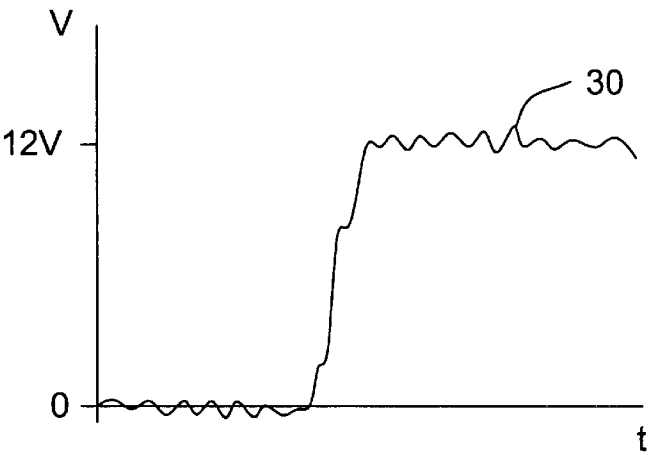
FIG. 2 is a graphical illustration of the signal contained on the single I/O wire of a standard 3 wire interconnect for hazardous condition detectors upon detection of a smoke condition by at least one of the interconnected hazardous condition detectors.

In view of these principles, the communications protocol for an interconnected hazardous condition detection system generates different signals for transmission on the single I/O wire 28 of the standard interconnect 22. The detectors that are interconnected and receive this I/O wire 28 will either understand certain signals and alarm appropriately, or they will not understand the signal, ignore it, and will not alarm at all. To ensure that conventional, deployed smoke detectors will alarm at the appropriate time, the communications protocol of the instant invention ensures that a "standard" smoke alarm signal, such as that illustrated in FIG. 2, is generated any time a smoke condition is sensed. For any other type of sensed hazardous condition as in, for example, a carbon monoxide condition, a type of signal that will not be recognized by the conventional smoke detectors is generated.

Since conventional smoke detectors 12 do not have the intelligence to understand the signals indicating the detection of hazardous conditions other than smoke, it is important that the signals utilized in the communications protocol to indicate such conditions do not inadvertently trigger the level sensing circuitry within these conventional detectors 12. In other words, it is important that these conventional detectors 12 ignore signals on the I/O line 28 that are meant to indicate some other hazardous condition. For example, when the combination detector 20 senses a carbon monoxide condition, it will transmit a CO hazard alarm signal on line 28 to all detectors coupled to the system 10. Conventional smoke alarms 12 will not be triggered by this signal, and carbon monoxide detectors 16, 18 will generate their alarm temporal patterns. Further, the intelligent smoke detector 14 that is capable of sounding alarm temporal patterns based upon the received communication signal will also begin sounding the carbon monoxide alarm, even though it was unable to originally sense the carbon monoxide condition. Conversely, when the combination unit 20 senses a smoke condition it will transmit a conventional smoke alarm signal, such as that illustrated in FIG. 2, on line 28. Conventional smoke detectors 12 will recognize this signal and enter an alarm condition, as will intelligent smoke detector 14. The carbon monoxide detector 16 is unable to sound the smoke alarm temporal pattern, and will therefore remain silent. However, the intelligent carbon monoxide detector 18 is capable of sounding a smoke alarm temporal pattern, and so will begin to do so.

Since the signaling protocol of the instant invention is designed to allow for backward compatibility with existing interconnected systems, an aspect of a preferred embodiment of this protocol is its inherent noise immunity. Many existing interconnect systems utilize fairly inexpensive wire in long lengths to form the interconnect 22 between the various disbursed detectors throughout a dwelling. Because of this, a large amount of electrical noise is present on these wires. This may be seen by the conventional smoke alarm signal 30 illustrated in FIG. 2. While this signal 30 illustrates fairly random noise superimposed on the step DC voltage signal, it must be noted that a large component of this noise is the 60 Hz noise introduced from the electric power wiring within the dwelling and carried on lines 24, 26. As will be recognized by one skilled in the art, this smoke alarm signal 30 is inherently resistant to electrical noise induced on the signal I/O wire 28 because the alarm condition is indicated simply by sending a relatively large DC voltage step change on the wire 28 to indicate the alarm condition. As described above, conventional systems utilize a 12 volt signal for this purpose since the amount of electrical noise induced on this wire 28 is typically much less than 12 volts. While it is theoretically possible to utilize different voltage levels to indicate the various hazard conditions, such is nearly precluded for systems 10 utilizing currently deployed, conventional interconnect wiring 22 due to the amount of noise present on the signal wire 22.

To provide the functionality desired in the next generation hazardous condition detector systems, and to overcome the induced noise problem described above, the communications protocol of the instant invention transmits pulse signals of a magnitude sufficient to be detected by the distributed detectors over the induced noise contained on the signal I/O wire 28. For example, the pulsed signal may have the same magnitude as the smoke alarm signal 30 illustrated in FIG. 2 and discussed above. However, unlike the typical smoke alarm signal 30, the communications protocol of the instant invention dictates that the pulsed signals indicating other detected hazardous conditions must not cause the level sensing alarm circuitry of conventional smoke detectors 12 (See FIG. 1) to sense an alarm condition. The communications protocol of the instant invention, therefore, utilizes pulsed signals having a duration of between 25 to 50 milliseconds for every 100 millisecond period (i.e., approximately 10 Hz). The duty cycle of this pulsed signal may be adjusted, and is preferably set to 50% to ensure adequate detection by all of the distributed detectors throughout the system 10.

While the approximately 10 Hz, 50% duty cycle, 12 volt signal described above is sufficient for indicating the presence of a non-smoke hazardous condition (for example carbon monoxide), it is preferred that the communications protocol be capable of indicating other hazardous conditions, as well as other information to the distributed, to the interconnected detectors. To accomplish this, the protocol of the instant invention utilizes a multi-pulse pattern of the signals to communicate the desired information to the interconnected detectors. In a preferred embodiment, the communications protocol of the instant invention utilizes an 8 pulse or 8 bit protocol to communicate the alarm information to the interconnected detectors. One skilled in the art will recognize however that more or fewer pulses in the pattern may be utilized to convey additional or less information as required by the system design. This information main contain, in addition to the carbon monoxide alarm condition, a low battery indication, hush mode of operation indication, test mode of operation indication, additional hazardous conditions, etc.

Figure 3:
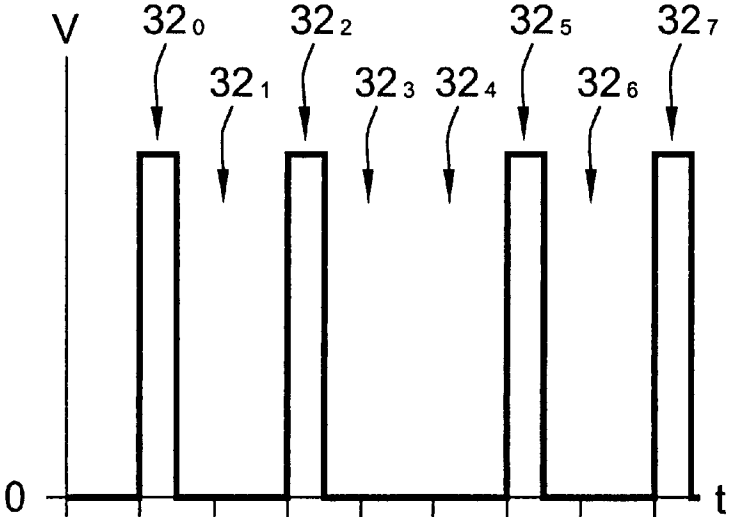
FIG. 3 is a graphical illustration of a carbon monoxide alarm condition I/O signal generated by a hazardous condition detector in accordance with an embodiment of the communications protocol of the instant invention.

FIG. 3 illustrates an exemplary alarm signal generated in accordance with the communication protocol of the instant invention. The pulses that comprise this 8 bit signal are of approximately 50% duty cycle to ensure that the receiving units may properly interrupt these bits despite the electrical noise present on the signal I/O wire. As described above, these pulses $\mathbf{32}_0$, $\mathbf{32}_1$, $\mathbf{32}_2$, $\mathbf{32}_3$, $\mathbf{32}_4$, $\mathbf{32}_5$, $\mathbf{32}_6$, and $\mathbf{32}_7$ comprise either 12 volt pulses of between 25 to 50 milliseconds in length for each 100 millisecond period allowed for each bit (to indicate a logic level 1), or a ground signal for the entire duration of the bits time interval (to indicate a logic level 0). The exemplary alarm signal illustrated in FIG. 3 may provide indication of a carbon monoxide alarm condition, and has the digital equivalent of the 8 bit signal 10100101.

Figure 4:
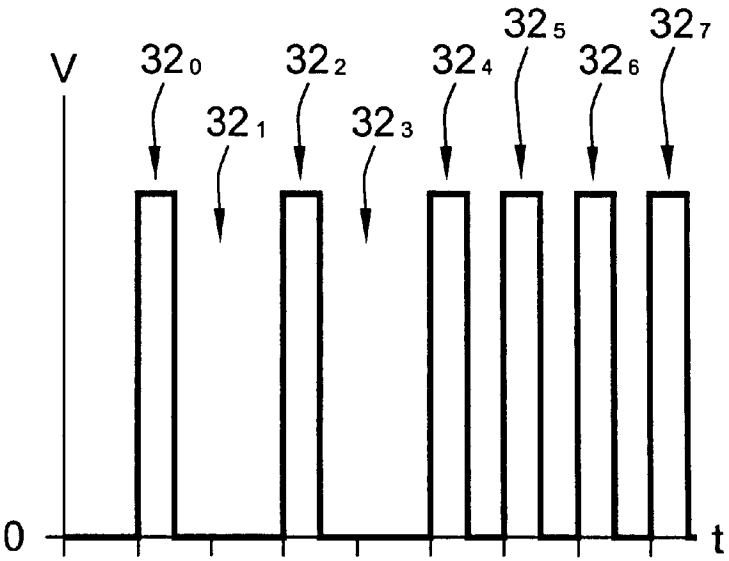
FIG. 4 is a graphical illustration of an alternative alarm signal generated in accordance with the communications protocol of the instant invention.

FIG. 4 illustrates an additional exemplary signal generated in accordance with the teachings of the communications protocol of the instant invention. As will be apparent to those skilled in the art, this signal conveys different information than the signal illustrated in FIG. 3. However, as will also be recognized by those skilled in the art the first or upper nibble of this signal (the first 4 bits of the 8 bit byte) contains the identical signaling pattern as the signal in FIG. 3. This identical upper nibble is used in one embodiment of the communications protocol of the instant invention to indicate to the receiving interconnected detectors that alarm or other control information will be following in the second or lower nibble of the 8 bit byte. Under such a scheme, the lower nibble (comprising bits $\mathbf{32}_4$, $\mathbf{32}_5$, $\mathbf{32}_6$, and $\mathbf{32}_7$) can convey 16 separate messages to the interconnected detectors ($2^4$= 16).

However, if additional information is required to be conveyed, an alternate embodiment of the protocol of the instant invention may use both the upper and lower nibble to provide alarm and control information to the interconnected detectors. In such a case, the protocol of the instant invention provides a control word (8 bits) that indicates to all of the interconnected detectors that an 8 bit byte of information will follow. In this way, a leading logic level 0 may be properly interpreted as such by the interconnected detectors. Otherwise, this leading logic level 0 may not be discerned by these detectors who may then improperly think that the first logic level 1 is the first bit of the alarm signal. This obviously could result in an erroneous alarm condition being indicated, or an inappropriate action being taken by the interconnected detectors.

Figure 5:
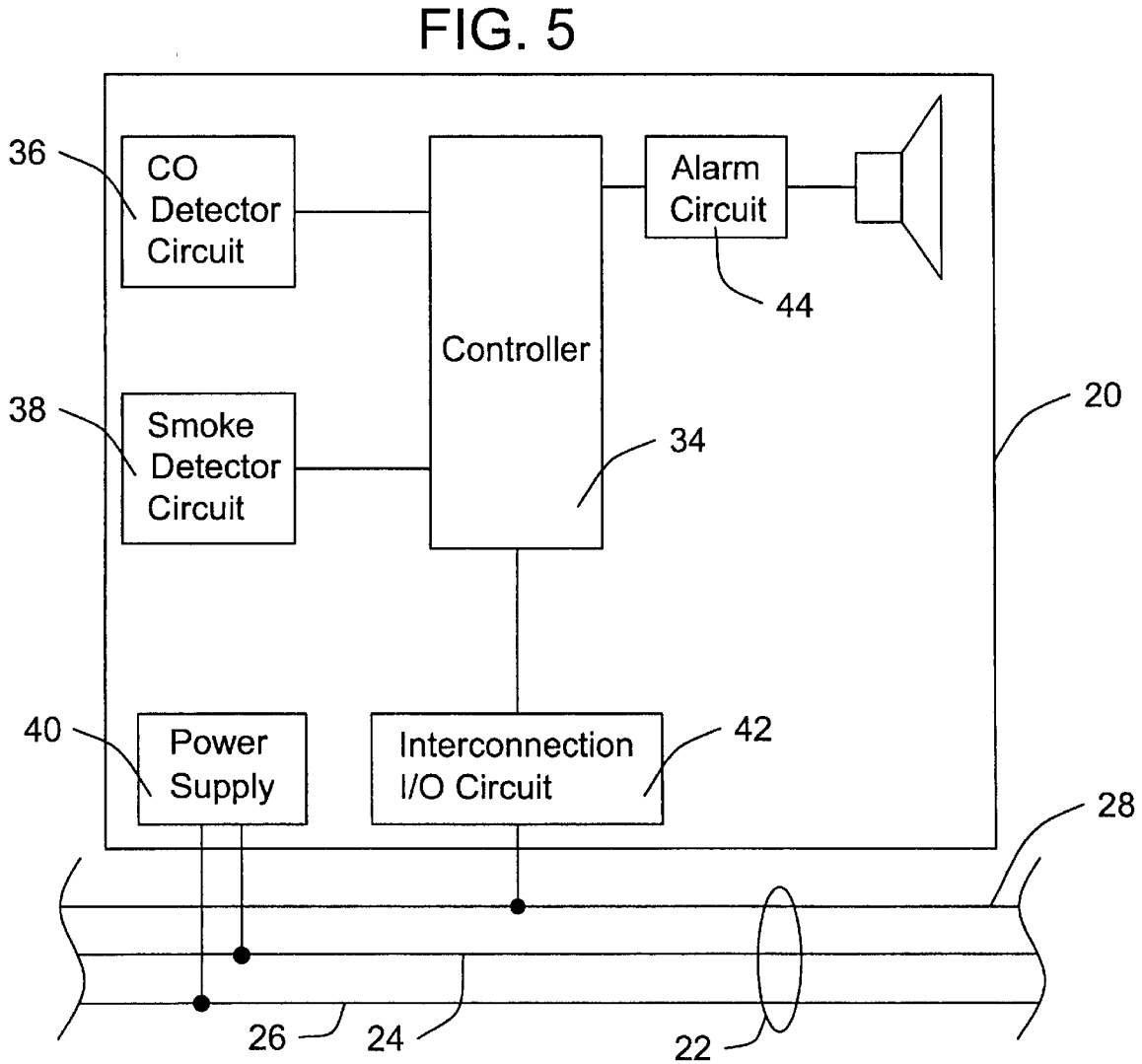
FIG. 5 is a block diagram of an exemplary hazardous condition detector constructed in accordance with the teachings of the instant invention.

FIG. 5 illustrates an internal block diagram of a detector 20 constructed in accordance with the teachings of the instant invention capable of generating and interpreting the communications protocol described above. While this block diagram illustrates a combination smoke and carbon monoxide detector 20, one skilled in the art will recognize that the type of detector circuit included is not a limiting aspect of the instant invention. As illustrated, the detector 20 includes a microcontroller 34 that processes all of the information received from the carbon monoxide detector circuit 36 and the smoke detector circuit 38. Both of these detector circuits 36, 38 are of conventional construction whose particular topology may be varied without departing from the scope of the invention described herein. The detector 20 also includes a power supply 40 which may be capable of receiving power from the 3 wire interconnect lines 24, 26, as well as possibly utilizing internal battery power for its operation. The microcontroller 34 also is in communication with an interconnection I/O circuit 42 which couples to the single interconnect I/O signal wire 28 of the 3 wire interconnect 22. This detector 20 preferably includes a single alarm circuit 44 to generate the required alarms as determined by the onboard detector circuits 36, 38 or from an interpretation of the interconnect I/O signal carried on the signal I/O line 28 of the 3 wire interconnect 22. This alarm circuit may include audible as well as visual alarming capabilities, as well as the capability for voice synthesized alarms as desired.

The microcontroller 34 of the detectors constructed in accordance with the teachings of the instant invention will generate alarm signals to the alarm circuit 44 upon the detection of a hazardous condition by its onboard detector circuits 36, 38. Such alarm generation will continue so long as the onboard detector circuits 36, 38 continue to sense the hazardous condition. In addition to generating the alarm signal for the alarm circuit 44, microcontroller 34 will also generate the proper alarm signal information to be transmitted via the interconnection I/O circuit 42 to the other interconnected hazardous condition detectors via the single signal I/O wire 28 of interconnect 22. If the condition detected is smoke, controller 34 will command interconnection I/O circuit 42 to transmit a constant 12 volt DC level on wire 28 so that all of the interconnected detectors may then sound their smoke alarm temporal patterns. Such a signal will be recognized by all conventional smoke detectors capable of interconnection causing them to sound their smoke alarms. Carbon monoxide detectors that are not capable of sounding a smoke alarm temporal pattern will ignore this signal and remain silent, while carbon monoxide detectors that are capable of sounding a smoke alarm temporal pattern will recognize this signal and alarm appropriately. Other combination detectors will also recognize this signal and sound their smoke alarm temporal pattern. These other interconnected detectors will continue sounding their smoke alarm temporal patterns so long as this smoke alarm signal is present on line 28. These detectors may also include a time-out feature whereby they will continue sounding their alarm for a time-out period after the alarm signal on wire 28 has ceased. Such a time-out period may be set as desired, it is preferably 16 seconds.

If the hazardous condition detected is a carbon monoxide hazard, microcontroller 34 will provide appropriate signaling to the interconnection I/O circuit 42 to generate the 8 bit alarm signal that indicates to the interconnected detectors that a carbon monoxide hazard has been detected. Conventional smoke detectors will not recognize this signal and will remain silent. However, all other detectors that are capable of interpreting the signal in accordance with the communications protocol of the instant invention will sound their alarm temporal patterns for the carbon monoxide hazard. In systems that use a 16 second time-out period as described above, retransmission of the carbon monoxide hazard alarm signal may be accomplished periodically during the time-out period to maintain the interconnected detectors in an alarm state. Since receipt of the alarm signal will reset the time period in the interconnected detectors, this alarm signal need only be sent once during the time-out period. Alternatively, the microcontroller 34 may continuously command the generation of the proper alarm signal. This will obviously maintain all of the interconnected detectors in an alarm state regardless of their manufacturer or internal time-out period. As a further alternative, the interconnected detectors may simply latch the receipt of the alarm signal, and continue to sound their alarm temporal pattern until a subsequent "alarm-off" signal is received via the signal line 28. This would obviously require the initiating detector to transmit this alarm-off signal once the hazardous condition were no longer detected by its internal detection circuitry 36, 38. Unfortunately, this could result in continuous alarming by all of the interconnected detectors if the initiating detector were removed from the interconnection prior to sending the alarm-off signal. To preclude such continuous alarming, a manually initiated alarm-off signal could be sent from any of the interconnected detectors by a manually initiated reset operation. Such a reset could also be accomplished via a centrally located control panel if desired.

Figure 6:
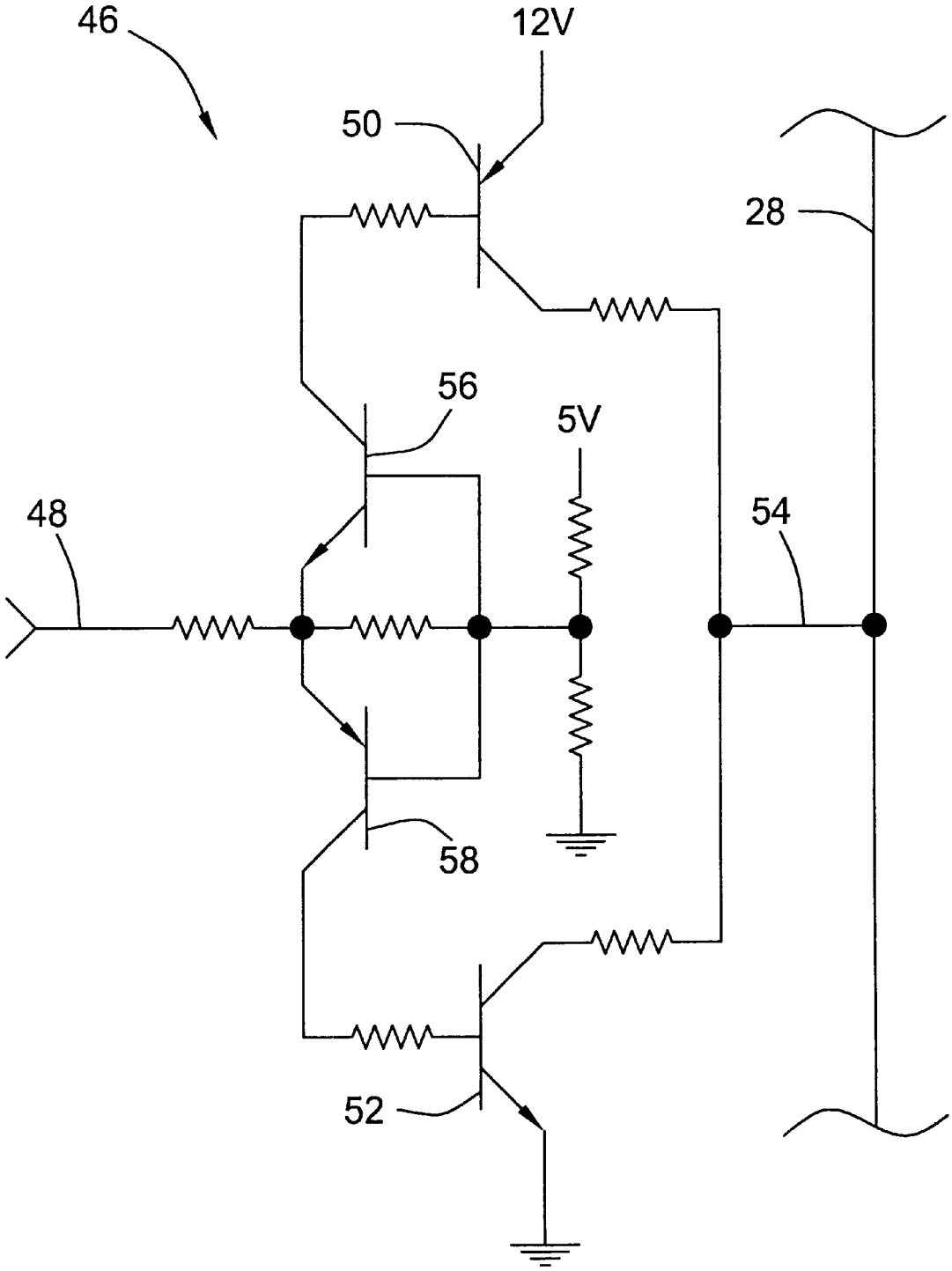
FIG. 6 is a simplified circuit schematic diagram of an embodiment of an interconnection I/O circuit constructed in accordance with the teachings of the instant invention.

The interconnection I/O circuit 42 may include typical input circuitry to the microcontroller's A/D input such as, for example, an emitter follower or comparator. Input noise filtering may also be included in this I/O circuitry 42 and may preferably include a 60 Hz filter as is known in the art. FIG. 6 illustrates an exemplary output portion of the interconnection I/O circuitry 42 capable of generating the alarm signals in accordance with the communications protocol of the instant invention. Specifically, this output circuitry 46 couples to the single I/O line 28 of the 3 wire interconnect. This circuitry is capable of generating either a 12 volt output, a ground output, or presents an open circuit to the signal I/O line 28 of the interconnect. When the associated detector does not sense any hazardous condition itself, this output circuitry presents an open circuit, thereby allowing the input circuitry of the associated detector to sense the input from other detectors coupled to line 28.

When the associated detector senses a smoke condition, microcontroller 34 generates an output signal coupled to line 48 of circuitry 46 which results in transistor 50 turning on and transistor 52 remaining off. In this way, this output circuitry 46 provides a 12 volt signal on its output 54 to signal line 28. When a carbon monoxide hazardous condition has been detected by the associated microcontroller 34, it generates a series of pulses on input line 48 resulting in transistors 50 and 52 switching in and out of conduction in association with these pulses to generate the appropriate output signal (such as those illustrated in FIGS. 3 and 4). Transistors 56, 58 are used to rapidly switch transistors 50 and 52 in and out of conduction. The result of this switching is that output 54 is coupled either to the 12 volt supply through transistor 50, or alternatively to ground through transistor 52. These two couplings present the logic level 1 and logic level 0 signals respectively on interconnection signal I/O wire 28.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A distributed hazardous condition detection and alarm system, comprising:

a first hazardous condition detector;

a second hazardous condition detector; and a 3-wire interconnect coupling said first detector to said second detector, and wherein at least one of said first and said second detectors is operable to generate a multi-pulse alarm message on the interconnect to indicate detection of carbon monoxide, and wherein at least one of said first and said second detectors is operable to generate a constant DC level on the interconnect to indicate detection of smoke.

* * * * *